US010016099B2

(12) United States Patent
Cittadino et al.

(10) Patent No.: US 10,016,099 B2
(45) Date of Patent: Jul. 10, 2018

(54) SHEET PRODUCT DISPENSERS AND RELATED METHODS FOR PROTECTING A ROLL OF SHEET PRODUCT AND REDUCING WASTE

(71) Applicant: GPCP IP HOLDINGS LLC, Atlanta, GA (US)

(72) Inventors: Antonio Michael Cittadino, Appleton, WI (US); Chevis James Watkinson, Appleton, WI (US); Timothy Andrew Robertson, Appleton, WI (US); Nickolas Everett Madsen, Atlanta, GA (US); Stuart Elizabeth Mullens, Savannah, GA (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 333 days.

(21) Appl. No.: 14/940,915

(22) Filed: Nov. 13, 2015

(65) Prior Publication Data

US 2016/0135652 A1 May 19, 2016

Related U.S. Application Data

(60) Provisional application No. 62/079,314, filed on Nov. 13, 2014.

(51) Int. Cl.
*A47K 10/38* (2006.01)
*B65H 16/00* (2006.01)
(Continued)

(52) U.S. Cl.
CPC ..... *A47K 10/38* (2013.01); *B65H 16/005* (2013.01); *B65H 16/06* (2013.01); *B65H 23/06* (2013.01);
(Continued)

(58) Field of Classification Search
CPC .... B65H 23/08; B65H 23/085; B65H 16/005; B65H 16/06; A47K 10/24; A47K 10/26;
(Continued)

(56) References Cited

U.S. PATENT DOCUMENTS 1,423,336 A 7/1922 Korittke
2,137,488 A 11/1938 Harvey
(Continued)

FOREIGN PATENT DOCUMENTS

GB 2145693 A 4/1985

*Primary Examiner* — William E Dondero
(74) *Attorney, Agent, or Firm* — Eversheds Sutherland (US) LLP

(57) ABSTRACT

A sheet product dispenser for dispensing sheet product from a roll of sheet product is provided. The sheet product dispenser includes a housing defining an interior space configured to receive the roll of sheet product therein, and a roll support positioned within the interior space and configured to rotatably support the roll of sheet product. The housing includes a dispensing gap in communication with the interior space and configured to allow a tail portion of the roll of sheet product to extend therethrough and out of the interior space, and a drainage gap in communication with the interior space and configured to allow a liquid to drain therethrough and out of the interior space. The drainage gap is spaced apart from the dispensing gap and positioned below the dispensing gap. A related method of protecting a roll of sheet product within a sheet product dispenser also is provided.

20 Claims, 8 Drawing Sheets

(51) Int. Cl.
*B65H 23/06* (2006.01)
*B65H 16/06* (2006.01)
*A47K 10/32* (2006.01)

(52) U.S. Cl.
CPC ..... *A47K 2010/3233* (2013.01); *A47K 2010/3863* (2013.01); *B65H 2301/41346* (2013.01); *B65H 2701/18484* (2013.01); *B65H 2701/1924* (2013.01)

(58) Field of Classification Search
CPC ..... A47K 10/32; A47K 10/34; A47K 2010/3206; A47K 2010/3233
USPC ..... 242/596.3
See application file for complete search history.

(56) References Cited

U.S. PATENT DOCUMENTS 2,601,956 A * 7/1952 Birr ..... A47K 10/34 242/564.1
3,516,615 A * 6/1970 Wickenberg ..... A47K 10/38 225/46
3,865,323 A 2/1975 Stronge et al.
3,893,738 A 7/1975 Bahnsen
4,611,768 A 9/1986 Voss et al.
4,739,943 A 4/1988 Geller
4,941,311 A 7/1990 Ardueser et al.
5,273,184 A 12/1993 Rizzuto
5,706,986 A 1/1998 Brandenburg et al.
5,803,373 A 9/1998 Sedlock, Jr. et al.
6,145,782 A 11/2000 King et al.
6,585,130 B2 7/2003 Turbett et al.
6,609,449 B2 8/2003 Granger
7,278,604 B1 10/2007 Constantino
8,177,156 B1 * 5/2012 Rinne ..... A47K 10/34 242/564.4
8,708,199 B2 4/2014 James
2004/0129825 A1 * 7/2004 Andersson ..... A47K 10/38 242/570
2013/0200201 A1 * 8/2013 Hjort ..... A47K 10/38 242/588.3

* cited by examiner

SHEET PRODUCT DISPENSERS AND RELATED METHODS FOR PROTECTING A ROLL OF SHEET PRODUCT AND REDUCING WASTE

CROSS-REFERENCE TO RELATED APPLICATIONS

This application claims the benefit of U.S. Provisional Application No. 62/079,314, filed on Nov. 13, 2014, which is incorporated by reference herein in its entirety.

FIELD OF THE DISCLOSURE

The present disclosure relates generally to sheet product dispensers and more particularly to sheet product dispensers and related methods for protecting a roll of sheet product and reducing waste during use in industrial environments.

BACKGROUND

Various types of sheet product dispensers are known in the art, including mechanical and automated dispensers configured to allow a user to obtain a length of sheet product from a roll of sheet product supported by the dispenser. Sheet product dispensers generally are configured to dispense a particular type of sheet product, such as paper towels, bath tissue, wipers, or napkins. Additionally, sheet product dispensers often are configured for use in a certain environment, such as a home, commercial, or industrial environment, taking into account the operating conditions and expected frequency of use.

According to certain configurations, sheet product dispensers may be relatively simple mechanical devices including a roll support configured to rotatably support the roll for dispensing sheet product therefrom. During use of such dispensers, the user may grasp a "tail" portion (i.e., an exposed free end portion) of the roll and apply a pull force thereto sufficient to rotate the roll about the roll support and unwind a length of sheet product from the roll. The user may separate the unwound length of sheet product from the roll by tearing the sheet product at a desired point, as may be facilitated by a tear bar of the dispenser or a predefined area of weakness, such as a line of perforations, defined in the sheet product.

In certain industrial environments, simple mechanical sheet product dispensers are common due to a high frequency of use and harsh operating conditions that deter the use of dispensers designed for home or commercial environments. For example, in the food processing industry, workers may use dispensers consisting of little more than a roll support, such as a spindle, for rotatably supporting a roll of sheet product, such as paper towels, and a means for attaching the roll support to a wall or other surface adjacent a workspace. Such simple dispensers have several shortcomings. First, they offer no protection for the roll of sheet product during daily operations or periodic wash-downs of the workspaces. Accordingly, the roll may be contaminated by food during use of the workspaces and may be saturated with a cleaning solution during wash-downs, requiring disposal of at least a portion of the roll and resulting in considerable waste of sheet product. Second, such dispensers do not provide controlled dispensing of the sheet product or prevent "over-spin" of the roll. In particular, the dispensers may allow "free-wheeling" of the roll as it rotates about the roll support during dispensing, causing a user to remove more sheet product than necessary and resulting in additional waste and user frustration. Third, such dispensers lack a means for facilitating separation of a length of sheet product from the roll. Accordingly, user interaction with the roll may be cumbersome, requiring the use of two hands to remove the length of sheet product and resulting in wasted time and user frustration.

There is thus a desire for improved sheet product dispensers and related methods for dispensing sheet product in certain industrial environments, such as food processing facilities. Such dispensers should address one or more of the shortcomings noted above while also being able to withstand the requisite high frequency of use and harsh operating conditions associated with the industrial environments.

SUMMARY

In one aspect, a sheet product dispenser for dispensing sheet product from a roll of sheet product is provided. The sheet product dispenser includes a housing defining an interior space configured to receive the roll of sheet product therein, and a roll support positioned within the interior space and configured to rotatably support the roll of sheet product. The housing includes a dispensing gap in communication with the interior space and configured to allow a tail portion of the roll of sheet product to extend therethrough and out of the interior space, and a drainage gap in communication with the interior space and configured to allow a liquid to drain therethrough and out of the interior space. The drainage gap is spaced apart from the dispensing gap and positioned below the dispensing gap.

In another aspect, a sheet product dispenser for dispensing sheet product from a roll of sheet product is provided. The sheet product dispenser includes a housing defining an interior space configured to receive the roll of sheet product therein, and a roll support positioned within the interior space and configured to rotatably support the roll of sheet product. The housing includes a dispensing gap in communication with the interior space and configured to allow a tail portion of the roll of sheet product to extend therethrough and out of the interior space, a drainage gap in communication with the interior space and configured to allow a liquid to drain therethrough and out of the interior space, and a first shield positioned at least partially within the drainage gap.

In still another aspect, a method of protecting a roll of sheet product within a sheet product dispenser also is provided. The method includes the steps of providing the roll of sheet product rotatably supported by a roll support within an interior space of a housing of the sheet product dispenser, allowing a tail portion of the roll of sheet product to extend through a dispensing gap of the housing and out of the interior space, and allowing a liquid to drain through a drainage gap of the housing and out of the interior space. The drainage gap is spaced apart from the dispensing gap and positioned below the dispensing gap.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
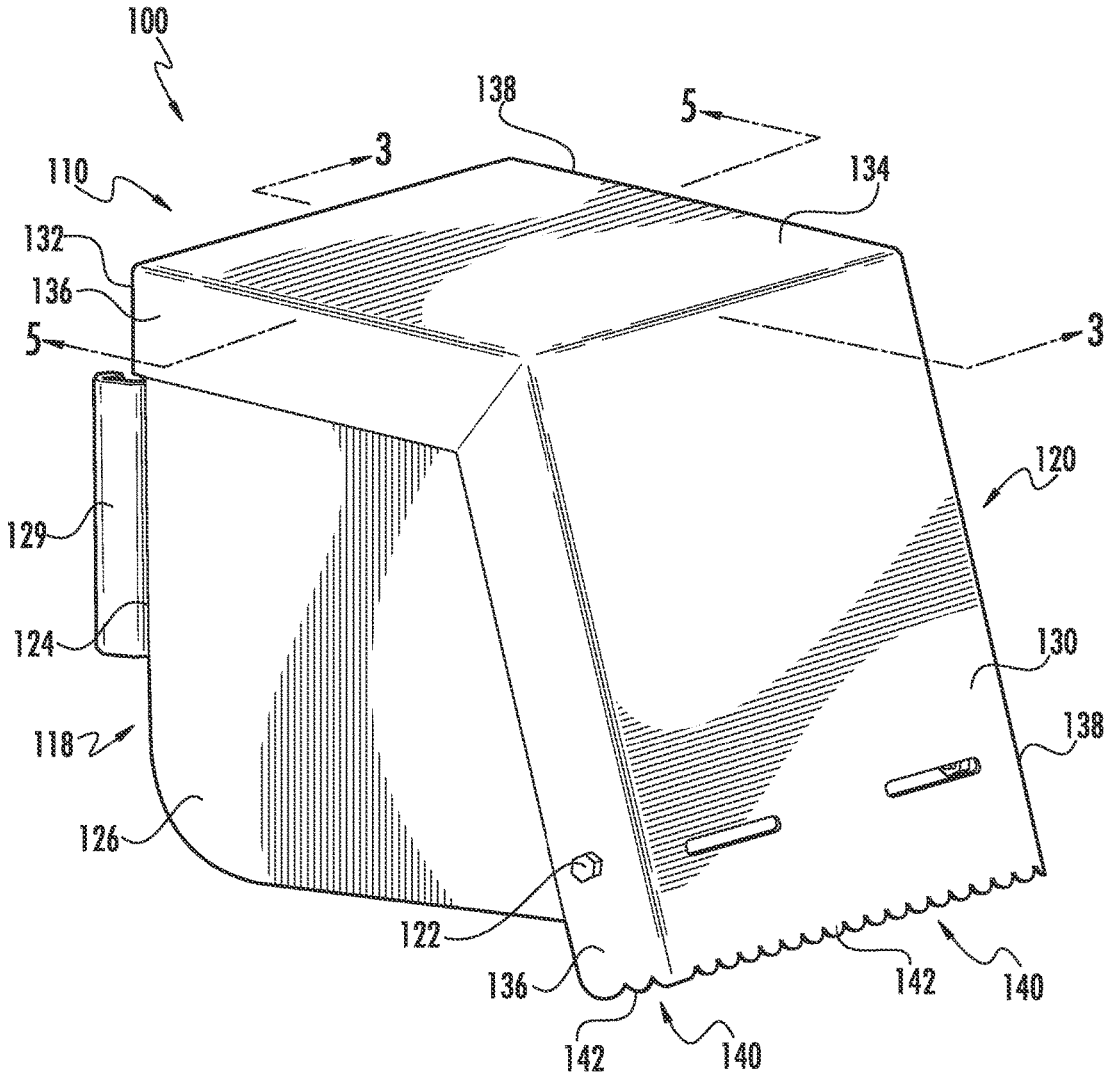
FIG. 1 is a front perspective view of a sheet product dispenser in accordance with one or more embodiments of the disclosure, showing a cover of the dispenser in a closed position for dispensing sheet product from the dispenser.
Figure 2:
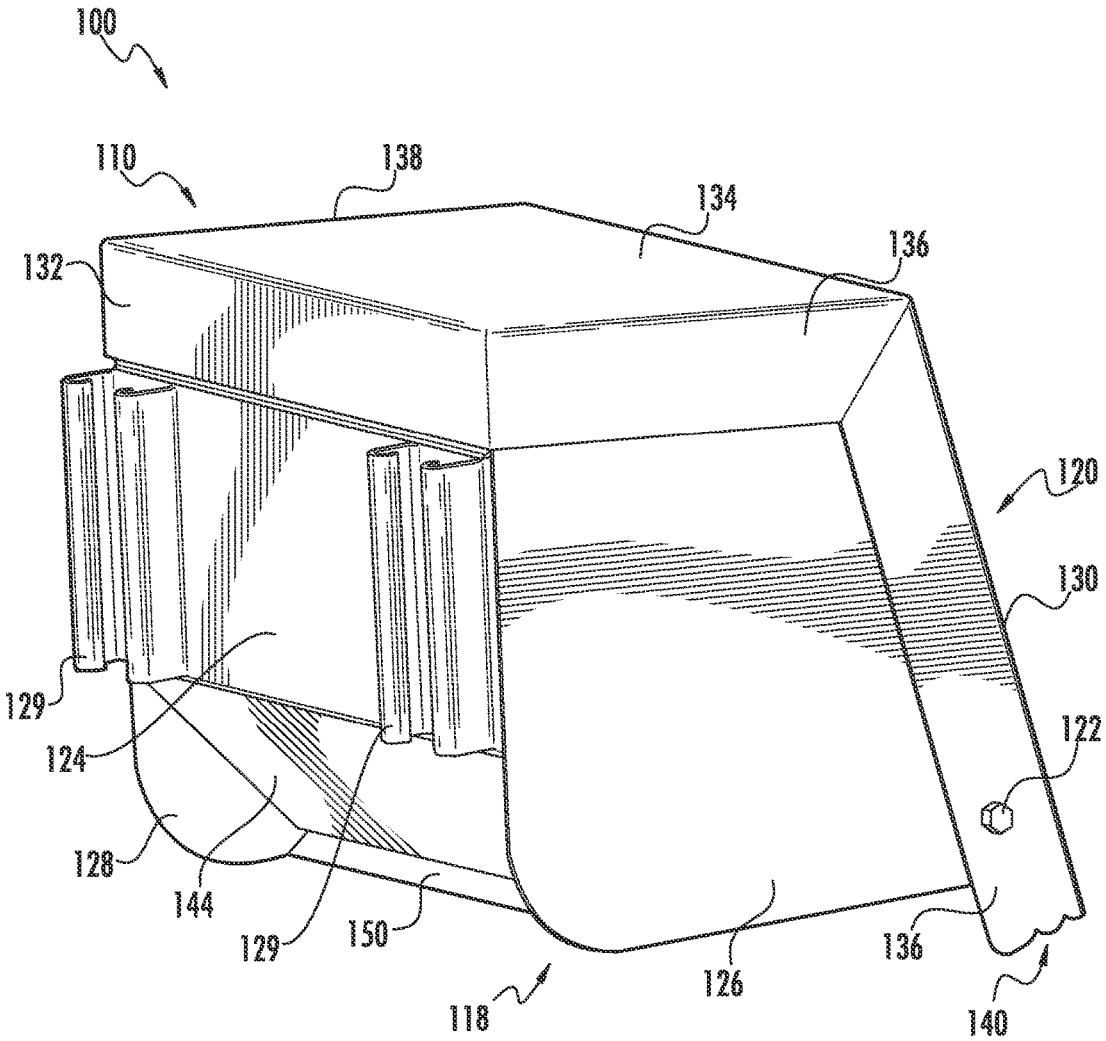
FIG. 2 is a back perspective view of the sheet product dispenser of FIG. 1, showing the cover of the dispenser in the closed position.

As described above, existing sheet product dispensers and related methods for dispensing sheet product in certain industrial environments, such as food processing facilities, have several shortcomings. In particular, such dispensers offer no protection for the roll of sheet product during daily operations or periodic wash-downs, do not provide controlled dispensing of the sheet product or prevent over-spin of the roll, and lack a means for facilitating separation of a length of sheet product from the roll. Ultimately, due to these shortcomings, such dispensers result in considerable waste of sheet product and user frustration.

The sheet product dispensers and related methods provided herein for dispensing sheet product in industrial environments advantageously protect the roll of sheet product to be dispensed, reduce undesirable waste of sheet product, and/or improve user experience. Importantly, as described in detail below, such dispensers and methods achieve these benefits through a relatively simple mechanical configuration that is able to withstand the requisite high frequency of use and harsh operating conditions associated with the industrial environments, such as food processing facilities.

The present disclosure includes non-limiting embodiments of sheet product dispensers and related methods for dispensing sheet product, which protect the roll of sheet product to be dispensed, reduce undesirable waste of sheet product, and/or improve user experience. The embodiments are described in detail herein to enable one of ordinary skill in the art to practice the sheet product dispensers and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "sheet product" is inclusive of natural and/or synthetic cloth or paper sheets. Sheet products may include both woven and non-woven articles. There are a wide variety of non-woven processes for forming sheet products, which can be either wetlaid or drylaid. Examples of non-woven processes include, but are not limited to, hydroentangled (sometimes called "spunlace"), double recreped (DRC), airlaid, spunbond, carded, papermaking, and melt-blown processes. Further, sheet products may contain fibrous cellulosic materials that may be derived from natural sources, such as wood pulp fibers, as well as other fibrous material characterized by having hydroxyl groups. Examples of sheet products include, but are not limited to, wipers, napkins, tissues, such as bath tissues, towels, such as paper towels, and other fibrous, film, polymer, or filamentary products. In general, sheet products are thin in comparison to their length and width and exhibit a relatively flat planar configuration but are flexible to permit folding, rolling, stacking, and the like. Sheet products may include predefined areas of weakness, such as lines of perforations, extending across their width between individual sheets to facilitate separation or tearing of one or more sheets from a roll or folded arrangement of the sheet product at discrete intervals. The individual sheets may be sized as desired to accommodate particular uses of the sheet product.

As used herein, the term "roll of sheet product" refers to a sheet product formed in a roll by winding layers of the sheet product around one another. Rolls of sheet product may have a generally circular cross-sectional shape, a generally oval cross-sectional shape, or other cross-sectional shapes according to various winding configurations of the layers of sheet product. Rolls of sheet product may be cored or coreless.

As used herein, the term "cored roll of sheet product" refers to a roll of sheet product that includes a core positioned therein. In this manner, the layers of the sheet product are wound around a core of paperboard or other material. A cored roll of sheet product includes a central opening extending therethrough along a longitudinal axis of the roll and defined by the core. A cored roll of sheet product may include one or more removable shafts, plugs, or other members positioned within the central opening for structural support during shipping or transportation, which may or may not be removed prior to loading the roll in or on a sheet product dispenser.

As used herein, the term "coreless roll of sheet product" refers to a roll of sheet product that does not include a core positioned therein. In this manner, the layers of the sheet product are not wound around a core of paperboard or other material. Instead, a coreless roll of sheet product includes a central opening extending therethrough along a longitudinal axis of the roll and defined by an inner layer of the sheet product itself. A coreless roll of sheet product may, however, include one or more removable shafts, plugs, or other members positioned within the central opening for structural support during shipping or transportation and removed prior to loading the roll in or on a sheet product dispenser.

The meanings of other terms used herein will be apparent to one of ordinary skill in the art or will become apparent to one of ordinary skill in the art upon review of the detailed description when taken in conjunction with the several drawings and the appended claims.

FIGS. 1-6 illustrate a sheet product dispenser 100 according to one or more embodiments of the disclosure. The dispenser 100 is configured to allow a user to obtain a length of sheet product from a roll 102 of sheet product supported by the dispenser 100. The sheet product may be paper towels, as may be used in food processing facilities, although other types of sheet product may be used in the dispenser 100. The roll 102 of sheet product may be formed in a conventional manner, whereby layers of the sheet product are wound around one another. The roll 102 may be a coreless roll of sheet product, including a central opening 104 extending therethrough along a longitudinal axis of the roll 102 and defined by an inner layer of the sheet product. Alternatively, the roll 102 may be a cored roll of sheet product, including a central opening 104 extending therethrough along a longitudinal axis of the roll 102 and defined by a core of paperboard or other material around which the layers of the sheet product are wound.

In some embodiments, the sheet product includes predefined areas of weakness, such as lines of perforations, extending across a width of the sheet product between individual sheets thereof. In this manner, a user may separate one or more sheets from the roll 102 by tearing the sheet product along one of the areas of weakness. In other embodiments, the sheet product includes no predefined areas of weakness, such that the sheet product is formed as a continuous sheet. In this manner, a user may separate a length of sheet product from the roll 102 by tearing the sheet product at any desired location, as may be achieved by an abrupt pulling action and as may be facilitated by features of the dispenser 100 described below.

The sheet product dispenser 100 may include a housing 110, a roll support 160, and a resistance mechanism 180. As is shown in the figures, the roll 102 of sheet product may be disposed completely within the housing 110 for dispensing sheet product therefrom. The housing 110 may include a plurality of walls and may define an interior space 112 inward of the walls and configured to receive the roll 102 therein. The interior space 112 may be substantially closed by the housing 110, although certain gaps or openings may be defined by the housing 110, as described below. As is shown, the housing 110 may include a dispenser opening 114 defined about a bottom, front portion of the dispenser 100. During use of the dispenser 100, a tail portion 106 of the roll 102 may extend through the dispenser opening 114 and out of the housing 110, such that the tail portion 106 may be easily grasped and pulled by a user.

The housing 110 may include a base 118 (which also may be referred to as a "first housing portion") configured to attach to a wall or other support surface for mounting the dispenser 100 thereto. The housing 110 also may include a cover 120 (which also may be referred to as a "second housing portion") pivotally connected to the base 118 and configured to move between a closed position for dispensing sheet product from the dispenser 100, as is shown in FIGS. 1-3D, and an open position for loading a roll 102 of sheet product into the dispenser, as is shown in FIGS. 4A and 4B. Specifically, the cover 120 may be configured to pivot about one or more pivot connections 122 between the base 118 and the cover 120. In some embodiments, as is shown, the pivot connections 122 include nuts and bolts. Alternatively, the pivot connections 122 may include screws, pins, rivets, or other types of mechanical fasteners configured to pivotally connect the cover 120 to the base 118. As is shown, the base 118 may include a back wall 124, a first side wall 126, and a second side wall 128. In some embodiments, as is shown, the back wall 124 and the side walls 126, 128 are integrally formed with one another. Alternatively, one or more of the back wall 124 and the side walls 126, 128 may be separately formed and fixedly attached to one another. The back wall 124 and the side walls 126, 128 each may extend vertically, and the back wall 124 may be configured to attach to a vertical wall or other support surface for mounting the dispenser 100 thereto. In some embodiments, as is shown, the housing 110 may include one or more brackets 129 positioned along the back of the dispenser 100 and configured to attach to a vertical wall or other support surface. The brackets 129 may be integrally formed with the back wall 124 or separately formed and fixedly attached to the back wall 124. In other embodiments, the back wall 124 may include other features, such as one or more holes, to facilitate attachment of the dispenser 100 to a vertical wall of other support surface.

As is shown, the cover 120 may include a front wall 130, a back wall 132, a top wall 134, a first side wall 136, and a second side wall 138. In some embodiments, as is shown, the front wall 130, the back wall 132, the top wall 134, and the side walls 136, 138 are integrally formed with one another. Alternatively, one or more of the front wall 130, the back wall 132, the top wall 134, and the side walls 136, 138 may be separately formed and fixedly attached to one another. The back wall 132 and the side walls 136, 138 each may extend vertically. The front wall 130 and the top wall 134 each may be angled downward in a direction from the back of the dispenser 100 toward the front of the dispenser 100, which may prevent or inhibit (i.e., reduce the likelihood of) pooling of liquids on the outer surfaces of the cover 120 during and following wash-downs. As is shown, the side walls 136, 138 of the cover 120 may overlap the side walls 126, 138 of the base 118, respectively, when the cover 120 is in the closed position, which may prevent or inhibit liquids from entering the interior space 112 through gaps between the cover 120 and the base 118 during wash-downs.

The cover 120 may include a plurality of tear edges 140 extending along the bottom edges of the front wall 130 and the side walls 136, 138. In particular, as is shown, a first tear edge 140 may be defined along the bottom edge of the front wall 130, a second tear edge 140 may be defined along the bottom edge of the first side wall 136, and a third tear edge 140 may be defined along the bottom edge of the second side wall 138. The tear edges 140 may be configured to facilitate tearing of a length of sheet product from the roll 102 upon application of an abrupt pulling motion to the tail portion 106 of the roll 102. In this manner, the tear edges 140 allow for one-handed tearing of the length of sheet product from the roll 102. Because the tear edges 140 extend along the front wall 130 and the side walls 136, 138, the pulling motion may be applied toward the front of the dispenser 100 and/or toward one of the sides of the dispenser 100. In this manner, the tear edges 140 provide ease of use and flexibility for the user, regardless of the mounting orientation of the dispenser 100 with respect to a workspace. Moreover, because the tear edges 140 are features of the cover 120 itself (i.e., the tear edges 140 are defined along the bottom edges of the front wall 130 and the side walls 136, 138) and are not provided by a separate component, such as an attached tear bar, as in certain conventional dispensers, the configuration of the dispenser 100 is simplified and areas for potential grime buildup are minimized. For example, such a design may reduce or eliminate crevices in which debris and microorganisms can accumulate, resulting in a more hygienic dispenser and a more sanitary workspace. As is shown, the tear edges 140 each may include a plurality of rounded teeth 142. As opposed to sharp teeth often used in conventional dispensers, the rounded teeth 142 allow for safe user interaction with the dispenser 100, even if a user's hand contacts the tear edges 140 while grasping or pulling the tail portion 106. In this manner, the rounded teeth 142 prevent or reduce the likelihood of potential harm to the user, as may be particularly important with respect to safety requirements in food processing facilities.

The housing 110 also may include a plurality of plates (which also may be referred to generally as "barriers," "shields," "separators," "dividers," "buffers," or "screens") configured to prevent or inhibit liquids from entering the interior space 112, particularly during wash-downs. The plates also may be configured to facilitate draining of any liquids that do enter the interior space 112 as well as any moisture that may develop within the interior space 112. Specifically, the housing 110 may include a first angled plate 144 (which also may be referred to as a "back angled plate") and a second angled plate 146 (which also may be referred to as a "front angled plate") each extending between the side walls 126, 128 of the base 118 along the bottom portion of the housing 110, as is shown. The first angled plate 144 may be angled downward in a direction from the back of the dispenser 100 toward the front of the dispenser 100, and the second angled plate 146 may be angled downward in a direction from the front of the dispenser 100 toward the back of the dispenser 100. As is shown, the first angled plate 144 may extend downward from the back wall 124 and laterally to each of the side walls 126, 128. In some embodiments, the first angled plate 144 is integrally formed with the back wall 124 and/or one or both of the side walls 126, 128. Alternatively, the first angled plate 144 may be formed separately from the base 118 and fixedly attached to the back wall 124 and/or the side walls 126, 128. As is shown, the second angled plate 146 may extend laterally to each of the side walls 126, 128. In some embodiments, the second angled plate 146 is integrally formed with one or both of the side walls 126, 128. Alternatively, the second angled plate 146 may be formed separately from the base 118 and fixedly attached to the side walls 126, 128.

As is shown, the angled plates 144, 146 may be spaced apart from one another such that a drainage gap 148 (which also may be referred to as a "drainage opening") is defined therebetween along the bottom portion of the housing 110. In particular, the drainage gap 148 may be defined between the front edge of the first angled plate 144 and the back edge of the second angled plate 146 and may be in direct communication with the interior space 112. Based on their angled orientation, the angled plates 144, 146 may be configured to facilitate draining of any liquids that do enter the interior space 112, directing such liquids toward and through the drainage gap 148. In some embodiments, a width of the drainage gap 148 (i.e., a distance between the front edge of the first angled plate 144 and the back edge of the second angled plate 146) is between 0.25 inches and 2 inches, between 0.25 inches and 1 inch, or between 0.25 inches and 0.5 inches. As is shown, the drainage gap 148 may have a length equal to the distance between the first side wall 126 and the second side wall 128. In other words, the length of the drainage gap 148 may be equal to the length of each of the angled plates 144, 146.

The housing 110 also may include a first shield plate 150 (which also may be referred to as a "bottom shield plate," a "first shield," or a "bottom shield") extending between the side walls 126, 128 of the base 118 and positioned at least partially below the drainage gap 148. As is shown, the first shield plate 150 may extend laterally to each of the side walls 126, 128 along the bottom portion of the housing 110. In some embodiments, the first shield plate 150 is integrally formed with one or both of the side walls 126, 128. Alternatively, the first shield plate 150 may be formed separately from the base 118 and fixedly attached to the side walls 126, 128. The first shield plate 150 may be positioned at least partially within the drainage gap 148 (i.e., at least partially between the front edge of the first angled plate 144 and the back edge of the second angled plate 146). In some embodiments, as is shown, a top portion of the first shield plate 150 is positioned above the drainage gap 148, a bottom portion of the first shield plate 150 is positioned below the drainage gap 148, and an intermediate portion of the first shield plate 150 is positioned within the drainage gap 148. In some embodiments, as is shown, the first shield plate 150 has an inverted V-shape (i.e., a tip portion of the V-shape is directed upward and an open portion of the V-shape is directed downward), including a front portion angled downward in a direction from the back of the dispenser 100 toward the front of the dispenser 100, and a back portion angled downward in a direction from the front of the dispenser 100 toward the back of the dispenser 100. Based on this configuration, the first shield plate 150 may facilitate draining of liquids falling through the drainage gap 148 and also may prevent or inhibit liquids from entering the interior space 112 through the drainage gap 148. In some embodiments, the angled plates 144, 146 and the first shield plate 150 are configured (e.g., their spaced edges may be offset or overlap) to prevent a linear stream of liquid from directly entering the interior space 112 through the drainage gap 148. As is shown, a width of the first shield plate 150 (i.e., a distance between the front edge of the first shield plate 150 and the back edge of the first shield plate 150) may be greater than the width of the drainage gap 148. In this manner, the first shield plate 150 may overlap respective portions of the first angled plate 144 and the second angled plate 146. Although the first shield plate 150 is illustrated as having an inverted V-shape, the first shield plate 150 may have other shapes, such as a curved shape, configured to facilitate draining of liquids falling through the drainage gap 148 and/or to prevent or inhibit liquids from entering the interior space 112 through the drainage gap 148.

Figure 3A:
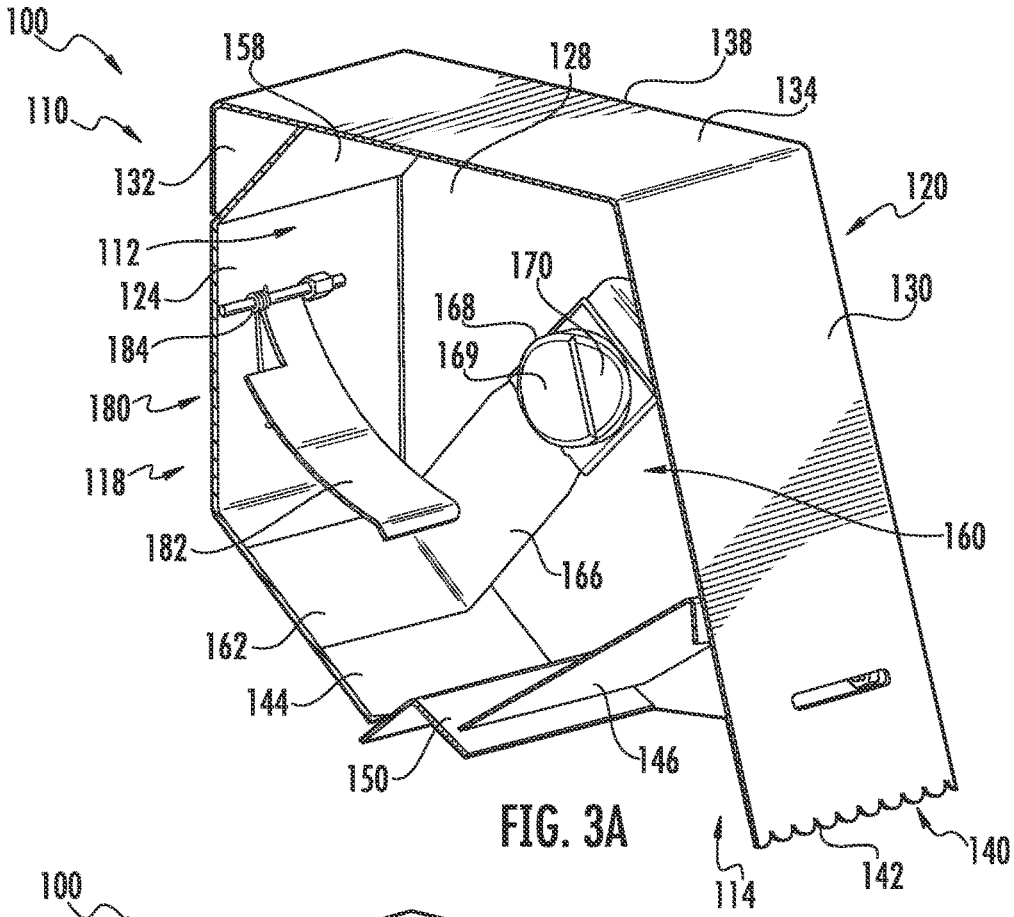
FIG. 3A is a front perspective cross-sectional view of the sheet product dispenser of FIG. 1 taken along line 3-3, showing the cover of the dispenser in the closed position.
Figure 3B:
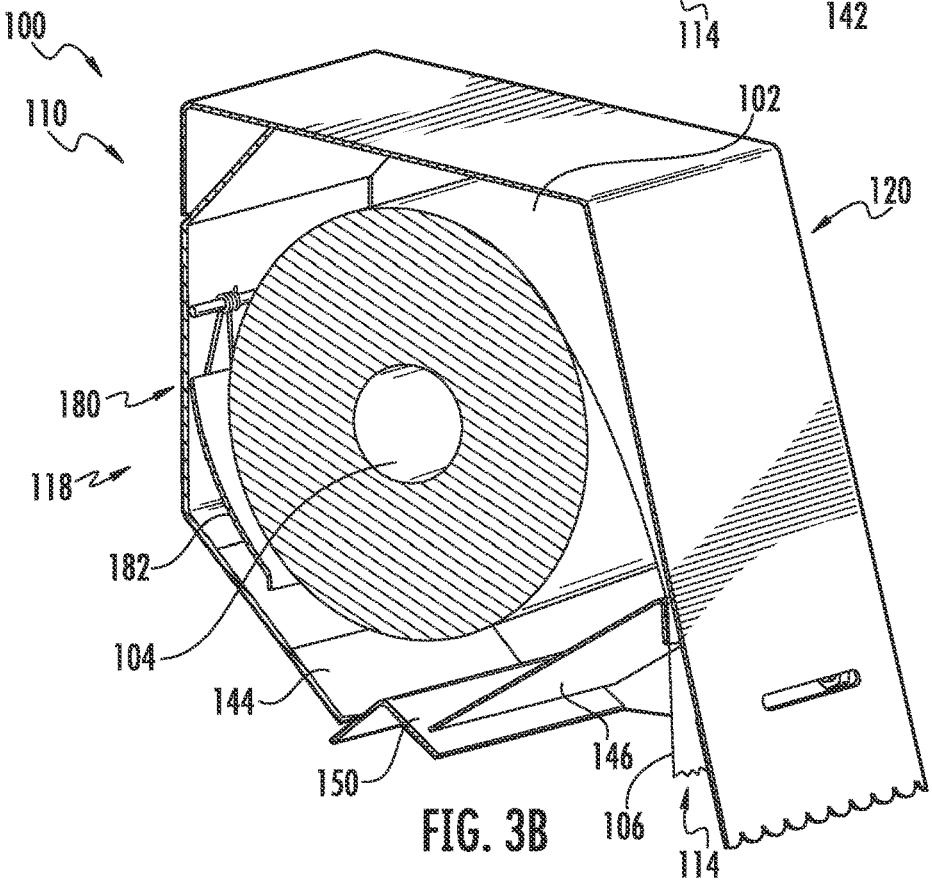
FIG. 3B is a front perspective cross-sectional view of the sheet product dispenser of FIG. 1 taken along line 3-3, showing a roll of sheet product loaded therein and the cover of the dispenser in the closed position.
Figure 3C:
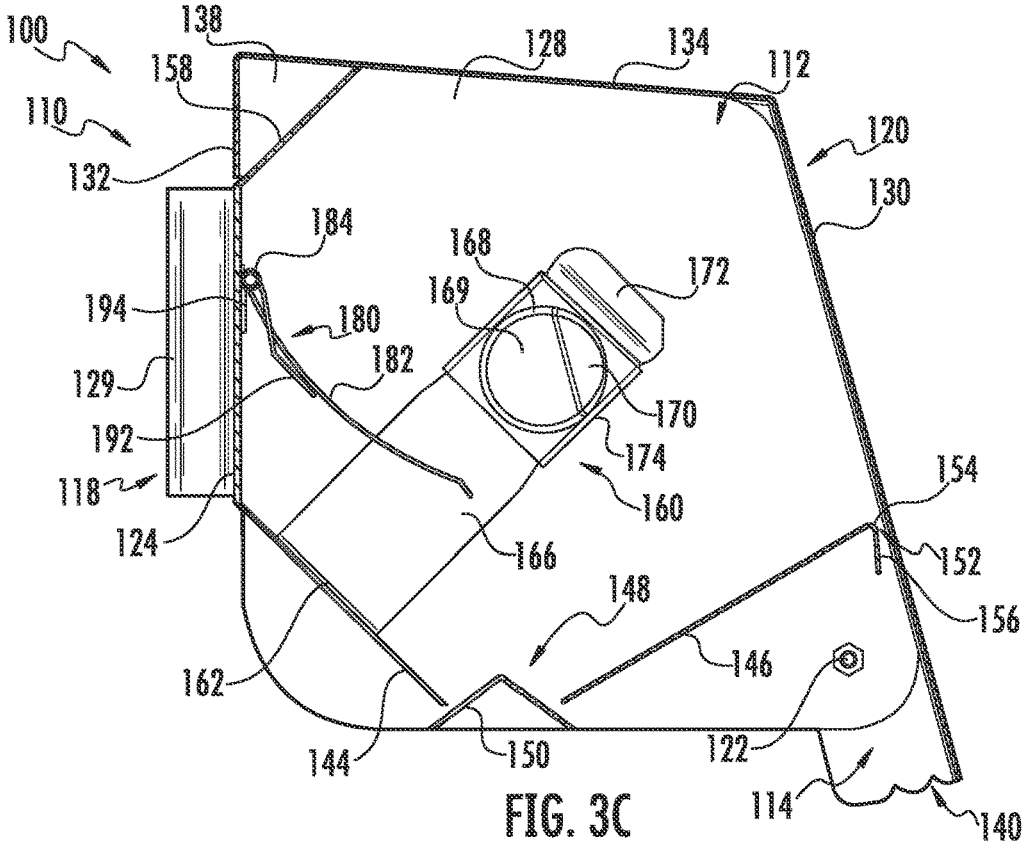
FIG. 3C is a side cross-sectional view of the sheet product dispenser of FIG. 1 taken along line 3-3, showing the cover of the dispenser in the closed position.
Figure 3D:
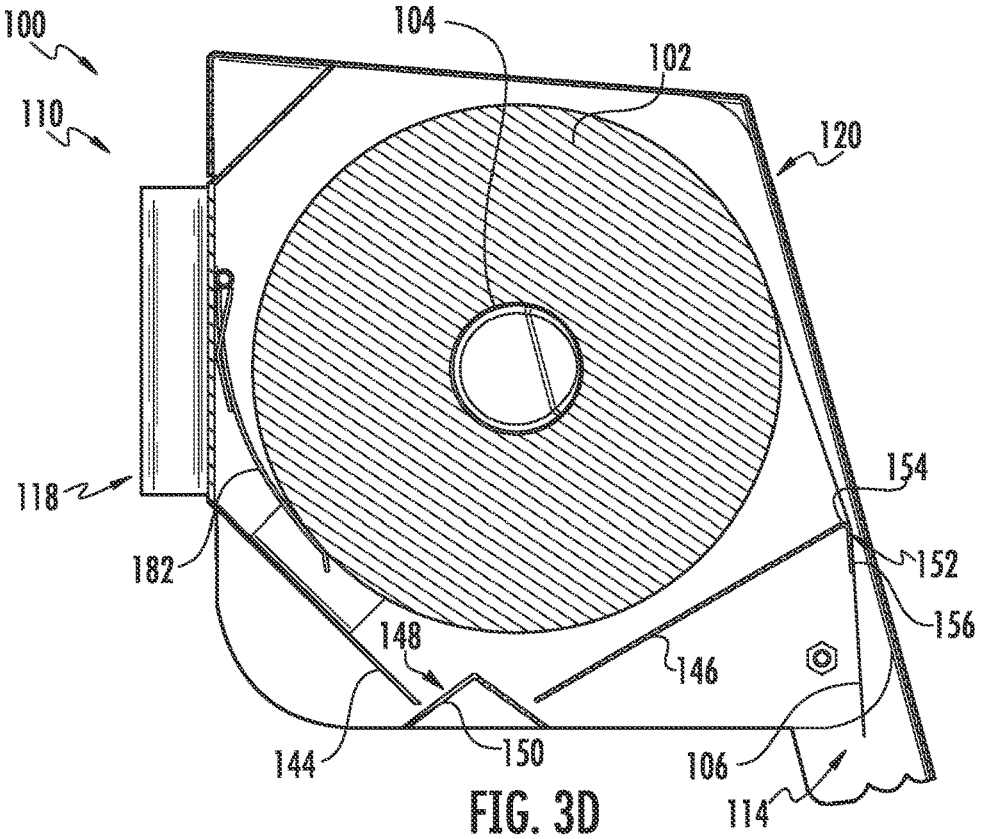
FIG. 3D is a side cross-sectional view of the sheet product dispenser of FIG. 1 taken along line 3-3, showing a roll of sheet product loaded therein and the cover of the dispenser in the closed position.
Figure 4A:
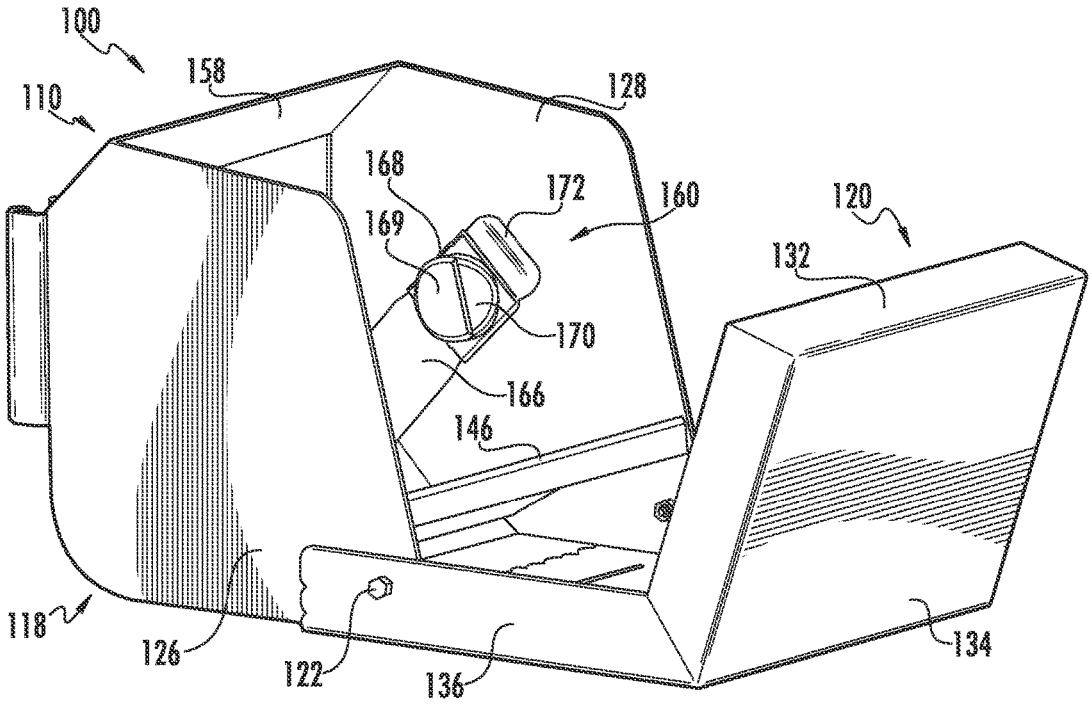
FIG. 4A is a front perspective view of the sheet product dispenser of FIG. 1, showing the cover of the dispenser in an open position for loading a roll of sheet product into the dispenser.
Figure 4B:
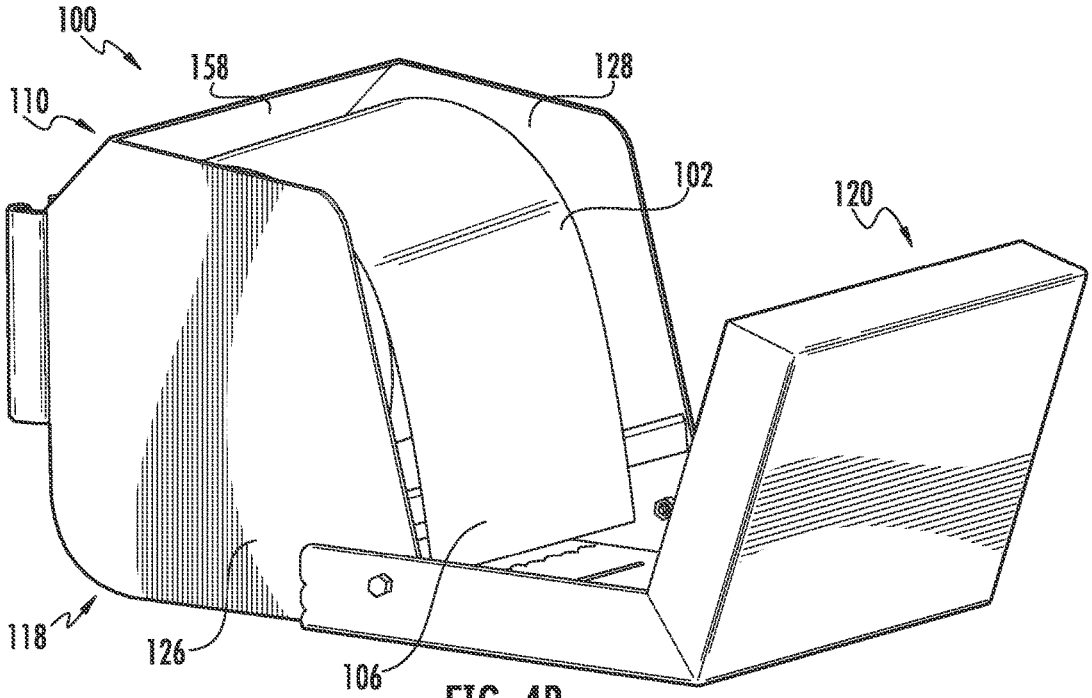
FIG. 4B is a front perspective view of the sheet product dispenser of FIG. 1, showing a roll of sheet product loaded therein and the cover of the dispenser in the open position.
Figure 5A:
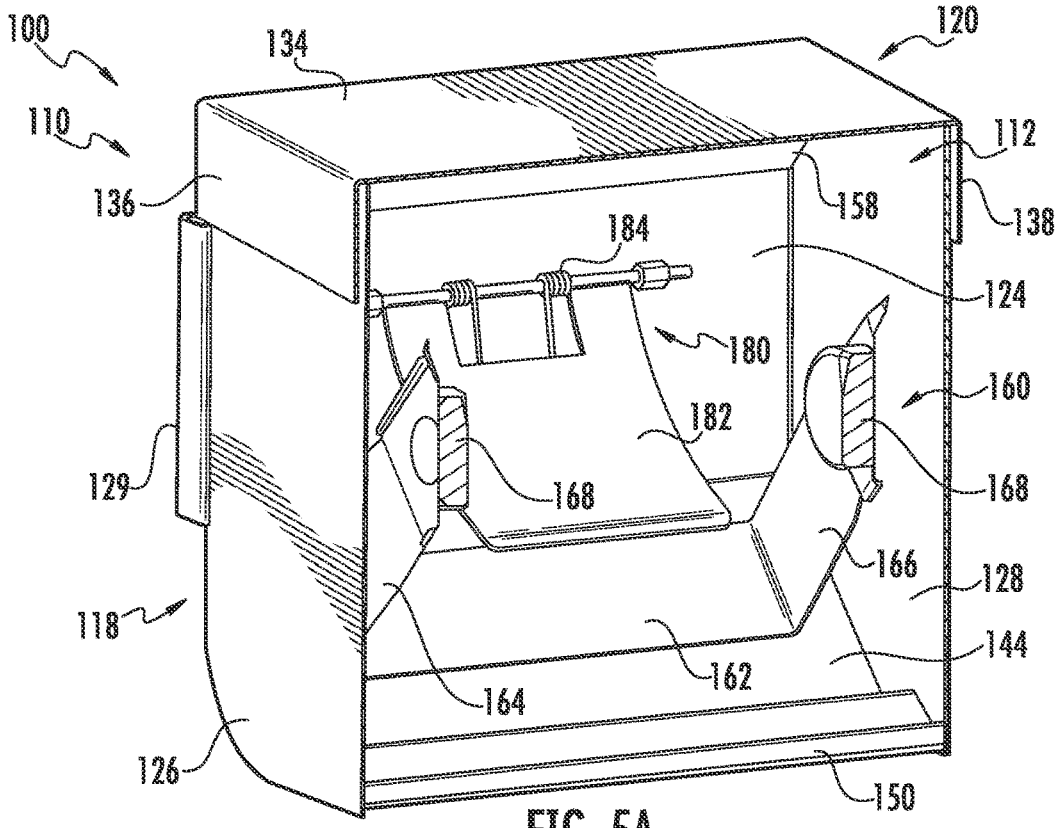
FIG. 5A is a front perspective cross-sectional view of the sheet product dispenser of FIG. 1 taken along line 5-5, showing the cover of the dispenser in the closed position.
Figure 5B:
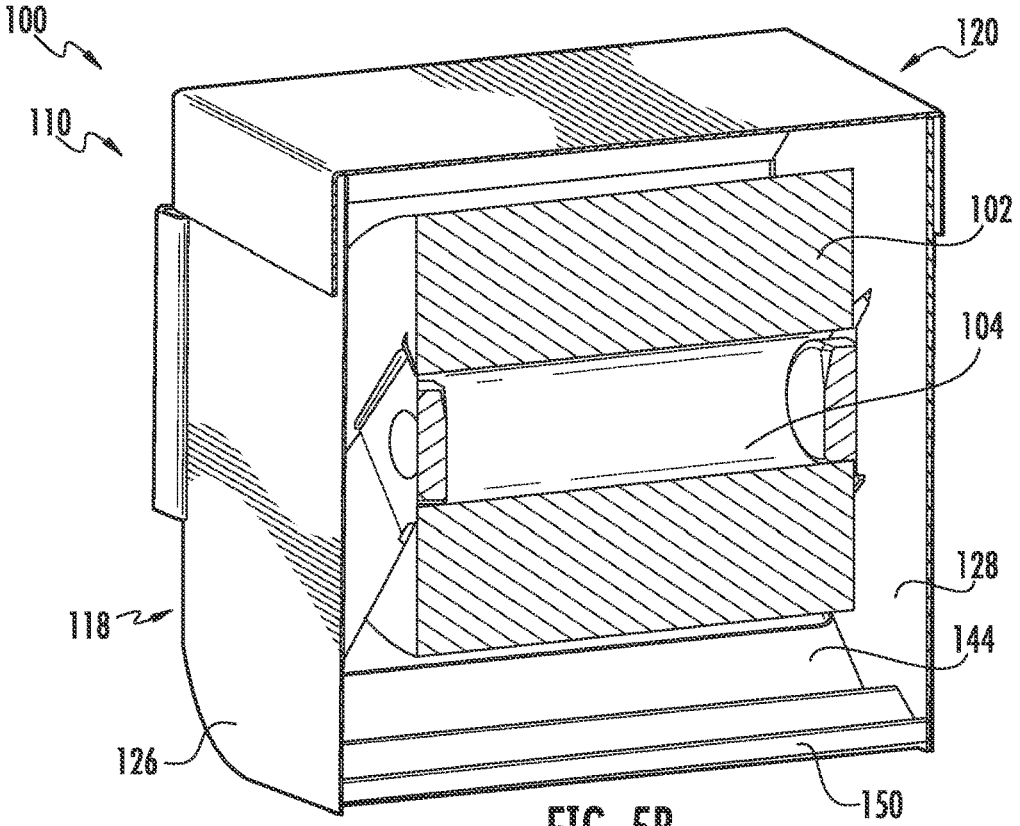
FIG. 5B is a front perspective cross-sectional view of the sheet product dispenser of FIG. 1 taken along line 5-5, showing a roll of sheet product loaded therein and the cover of the dispenser in the closed position.
Figure 5C:
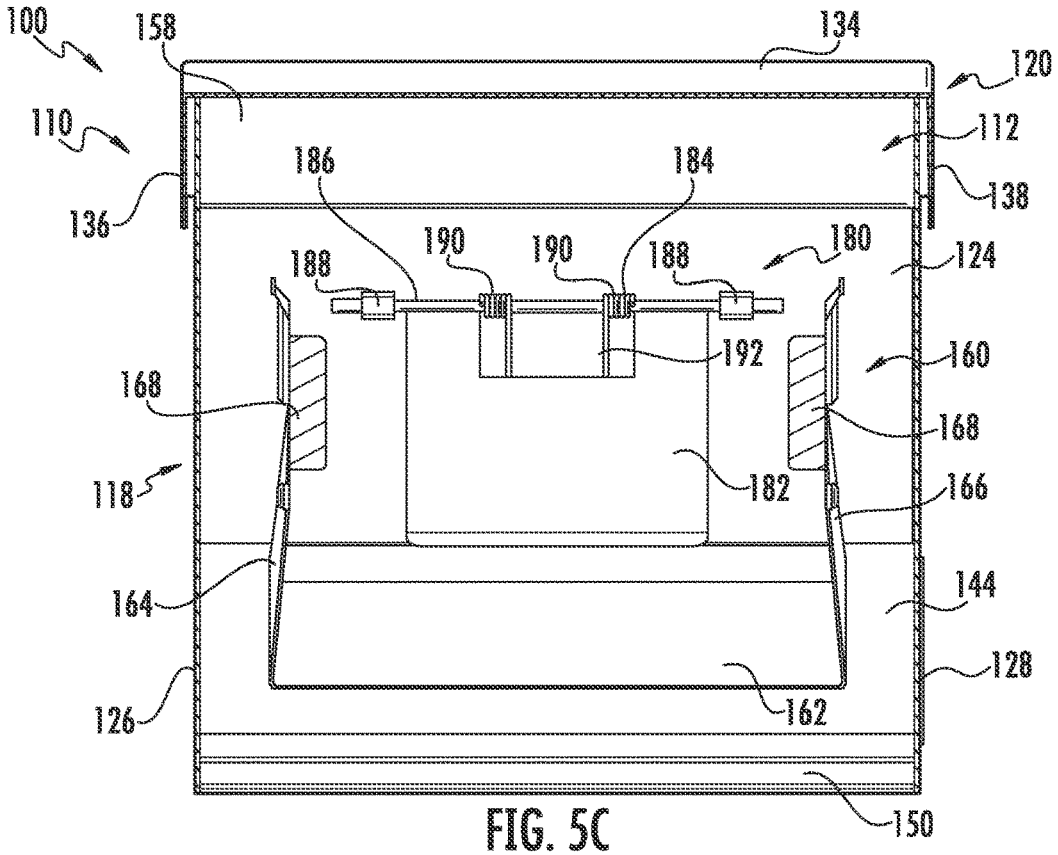
FIG. 5C is a front cross-sectional view of the sheet product dispenser of FIG. 1 taken along line 5-5, showing the cover of the dispenser in the closed position.
Figure 5D:
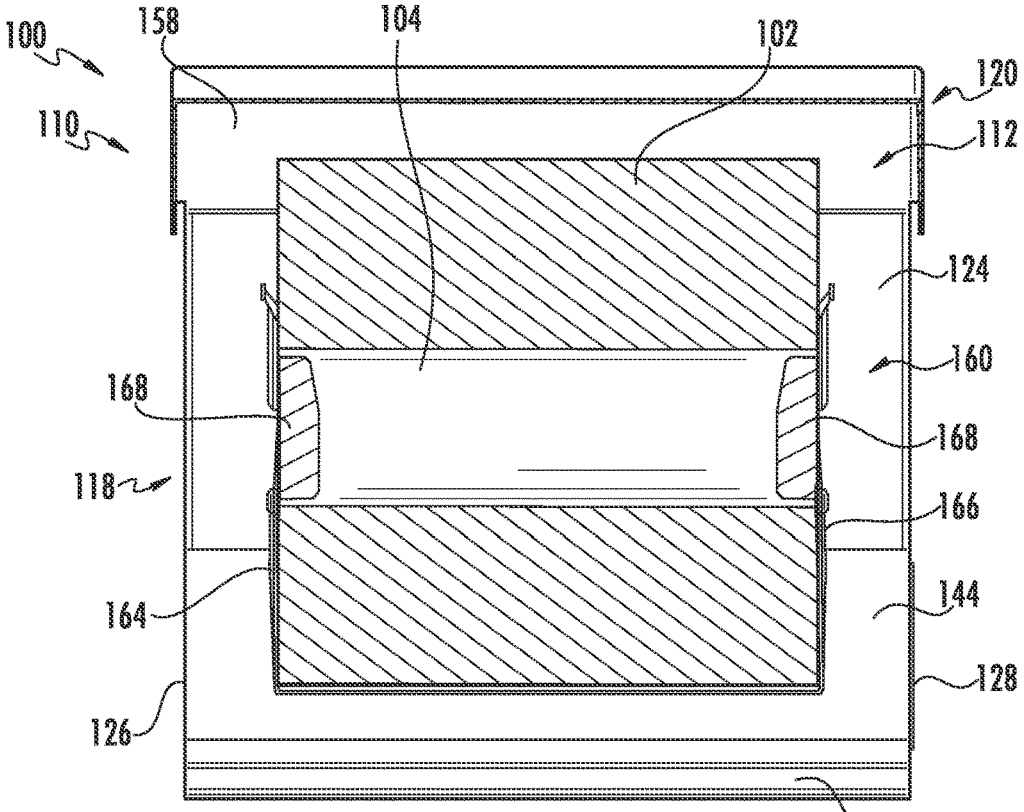
FIG. 5D is a front cross-sectional view of the sheet product dispenser of FIG. 1 taken along line 5-5, showing a roll of sheet product loaded therein and the cover of the dispenser in the closed position.
Figure 6:
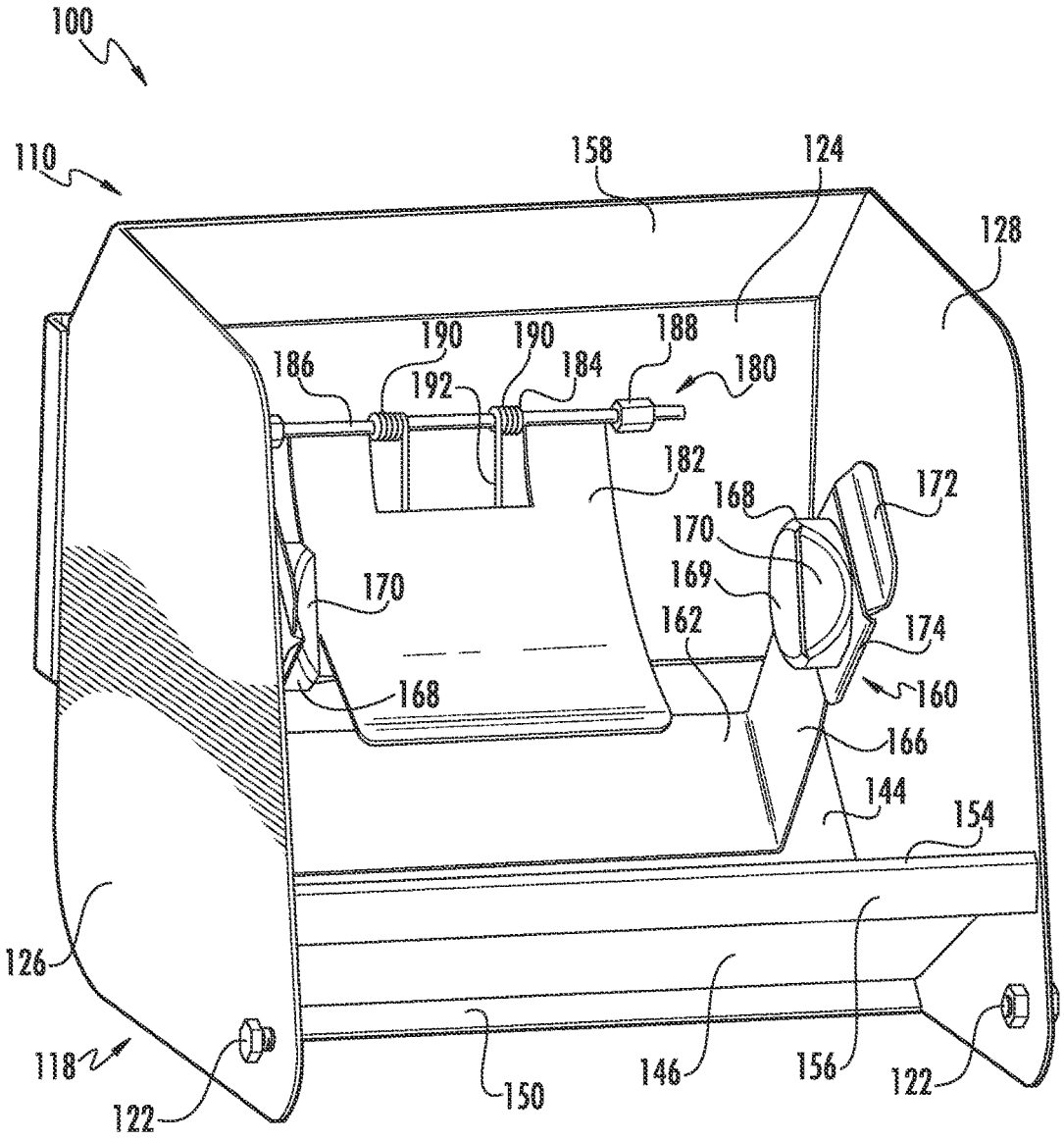
FIG. 6 is a front perspective view of the sheet product dispenser of FIG. 1 with the cover of the dispenser removed, showing a roll support and a resistance mechanism of the dispenser.

As is shown in FIGS. 3C and 3D, when the cover 120 is in the closed position, the second angled plate 146 and the cover 120 may be spaced apart from one another such that a dispensing gap 152 (which also may be referred to as a "dispensing opening") is defined therebetween, and the tail portion 106 of the roll 102 may extend through the dispensing gap 152. In particular, the dispensing gap 152 may be defined between the front end of the second angled plate 146 and the front wall 130 of the cover 120 and may be in direct communication with the interior space 112. In this manner, the dispensing gap 152 may be positioned along the front portion of the housing 110. In some embodiments, a width of the dispensing gap 152 (i.e., a distance between the front end of the second angled plate 146 and the front wall 130 of the cover 120) is between 0.1 inches and 1 inch, between 0.1 inches and 0.5 inches, or between 0.1 inches and 0.25 inches. As is shown, the dispensing gap 152 may have a length equal to the distance between the first side wall 126 and the second side wall 128. In other words, the length of the dispensing gap 152 may be equal to the length of the second angled plate 146. The front end of the second angled plate 146 may include a curved portion 154 and an angled flange 156, as is shown, which may facilitate feeding of the tail portion 106 through the dispensing gap 152 and toward the dispenser opening 114 to be grasped by a user. As the user applies a pull force to the tail portion 106, the curved portion 154 and/or the angled flange 156 may provide some resistance to the pull force, which may reduce over-spin of the roll 102. Additionally, the curved portion 154 and/or the angled flange 156 may be configured to prevent or inhibit liquids from entering the interior space 112 through the dispensing gap 152. As is shown, the angled flange 156 may extend downward away from the dispensing gap 152. In this manner, the angled flange 156 may block a stream of liquid that is directed at the second angled plate 146 from travelling along bottom of the second angled plate 146 and reaching the dispensing gap 152.

As is shown, the drainage gap 148 and the dispensing gap 152 may be spaced apart from one another (i.e., the drainage gap 148 and the dispensing gap 152 may be separate from and not in direct communication with one another). In particular, the drainage gap 148 may be spaced apart from the dispensing gap 152 by the second angled plate 146. As is shown, the drainage gap 148 may be positioned below the dispensing gap 152 (i.e., the drainage gap 148 may be positioned closer to the bottom of the dispenser 100 than the dispensing gap 152), and the drainage gap 148 may be positioned behind the dispensing gap 152 (i.e., the drainage gap 148 may be positioned closer to the back of the dispenser 100 than the dispensing gap 152). In other words, the dispensing gap 152 may be positioned above the drainage gap 148 (i.e., the dispensing gap 152 may be positioned closer to the top of the dispenser 100 than the drainage gap 148), and the dispensing gap 152 may be positioned in front of the drainage gap 148 (i.e., the dispensing gap 152 may be positioned closer to the front of the dispenser 100 than the drainage gap 148). As is shown, the width of the dispensing gap 152 may be less than the width of the drainage gap 148.

The housing 110 also may include a second shield plate 158 (which also may be referred to as a "top shield plate," a "second shield," or a "top shield") extending between the side walls 126, 128 of the base 118 and positioned above the back wall 124 along the top portion of the housing 110. The second shield plate 158 may be angled downward in a direction from the front of the dispenser 100 toward the back of the dispenser 100. As is shown, the second shield plate 158 may extend upward from the back wall 124 and laterally to each of the side walls 126, 128. In some embodiments, the second shield plate 158 is integrally formed with the back wall 124 and/or one or both of the side walls 126, 128. Alternatively, the second shield plate 158 may be formed separately from the base 118 and fixedly attached to the back wall 124 and/or the side walls 126, 128. As is shown in FIGS. 3A-3D, when the cover 120 is in the closed position, the second shield plate 158 may be positioned inward of the back wall 132 of the cover 120, and the top edge of the second shield plate 158 may contact the top wall 134 of the cover 120. In other words, the back wall 132 of the cover 120 may overlap the second shield plate 158, and the top edge of the second shield plate 158 may support the top wall 134 of the cover 120. In this manner, the second shield plate 158 may be configured to prevent or inhibit liquids from entering the interior space 112 at the interface of the second shield plate 158 and the top wall 134 of the cover 120. Additionally, based on its angled orientation, the second shield plate 158 may be configured to facilitate draining of any liquids that enter the space between the second shield plate 158 and the back wall 132 of the cover 120, directing such liquids toward and through a gap between the back wall 132 of the cover 120 and the back wall 124 of the base 118.

Ultimately, the configuration of the housing 110 protects the roll 102 of sheet product from direct exposure to liquids during wash-downs and facilitates draining of liquids that enter the interior space 112 of the housing 110. As will be appreciated, the configuration of the base 118, the cover 120, and the plurality of plates includes a limited number of exposed gaps and crevices, which minimizes potential grime buildup and provides ease of cleaning the dispenser 100.

As is shown in FIGS. 3A-6, the dispenser 100 may include the roll support 160 positioned within the interior space 112 and configured to rotatably support the roll 102 for dispensing sheet product therefrom. In particular, the roll support 160 may be configured to support the roll 102 above the drainage gap 148 (i.e., the bottom of the roll 102 may be positioned closer to the top of the dispenser 100 than the drainage gap 148) and behind the dispensing gap 152 (i.e., the front of the roll 102 may be positioned closer to the back of the dispenser 100 than the dispensing gap 152). The roll support 160 may be in the form of a bracket including a base plate 162, a first spring arm 164 (which also may be referred to as a "first support arm"), and a second spring arm 166 (which also may be referred to as a "first support arm"). The base plate 162 may be fixedly attached to the first angled plate 144 of the housing 110, and the spring arms 164, 166 each may extend away from the base plate 162 and the first angled plate 144, as is shown. The spring arms 164, 166 may be configured to elastically flex or deflect away from one another when a biasing force is applied thereto, such as by the roll 102 being loaded therebetween. In this manner, the spring arms 164, 166 may have a stable position (i.e., a natural default position), as is shown in FIG. 5C, in which the spring arms 164, 166 are angled inward toward one another and are spaced apart by a distance less than a length of the roll 102. As the roll 102 is mounted to the roll support 160, the spring arms 164, 166 may deflect away from one another to a deflected position, as is shown in FIG. 5D, in order to accommodate the roll 102 therebetween. In some embodiments, the spring arms 164, 166 each may be configured to elastically flex or bend along the length of the spring arm 164, 166. In other embodiments, the spring arms 164, 166 each may be configured to elastically flex or bend about the interface between the spring arm 164, 166 and the respective end of the base plate 162.

Each of the spring arms 164, 166 may include a protrusion 168 extending inwardly therefrom. The protrusions 168 may be generally cylindrical and configured for insertion into respective ends of the central opening 104 of the roll 102. As is shown, the protrusions 168 each may include a flat end surface 169 extending in a direction that is perpendicular to a longitudinal axis of the protrusion 168, and a flat angled surface 170 extending in a direction that is non-perpendicular and non-parallel to the longitudinal axis of the protrusion 168. In some embodiments, an angle between the angled surface 170 and the longitudinal axis of the protrusion 168 is between 30 degrees and 60 degrees, between 40 degrees and 50 degrees, or about 45 degrees. Based on their angled orientation, the angled surfaces 170 may facilitate insertion of the roll 102 between the spring arms 164, 166 and deflection of the spring arms 164, 166 away from one another until the protrusions 168 align with the respective ends of the central opening 104 of the roll 102 and become positioned therein. As is shown, the angled surfaces 170 may be oriented toward the front of the dispenser 100, corresponding to an angle of approach that a user generally may take when inserting the roll 102 between the spring arms 164, 166.

Each of the spring arms 164, 166 also may include a plurality of flanges positioned about the protrusion 168 of the spring arm 164, 166. In particular, each of the spring arms 164, 166 may include an end flange 172 and a pair of side flanges 174 positioned about the protrusion 168. As is shown, the end flange 172 and the side flanges 174 may be bent away from the protrusion 168 such that the flanges 172, 174 extend in a direction opposite the protrusion 168. In this manner, the end flange 172 and the side flanges 174 may facilitate insertion of the roll 102 between the spring arms 164, 166 and deflection of the spring arms 164, 166 away from one another until the protrusions 168 align with the respective ends of the central opening 104 of the roll 102 and become positioned therein. Additionally, the bent configuration of the flanges 172, 174 may reduce a contact area between the respective spring arm 164, 166 and a respective end of the roll 102, thereby reducing generation of paper dust as the roll 102 is rotated during use of the dispenser 100.

Ultimately, the configuration of the roll support 160, particularly the spring arms 164, 166 and the protrusions 168 including the angled surfaces 170, provides ease of mounting the roll 102 thereon. In fact, the roll support 160 advantageously allows for one-handed loading of the roll 102, as may be achieved by simply inserting the roll 102 between the spring arms 164, 166 and aligning the protrusions 168 with the central opening 104. Upon mounting the roll 102 onto the roll support 160, the tail portion 106 of the roll 102 may be positioned in front of the front end of the second angled plate 146, as is shown in FIG. 4B. The cover 120 then may be moved to the closed position, such that the tail portion 106 extends through the dispensing gap 152 and is ready to be grasped by a user, as is shown in FIG. 3D. In this manner, the configuration of the dispensing gap 152 being defined between the front end of the second angled plate 146 and the front wall 130 of the cover 120 advantageously provides ease of positioning the tail portion 106 through the dispensing gap 152.

As is shown in FIGS. 3A-3D and 5A-6, the dispenser 100 may include the resistance mechanism 180 positioned within the interior space 112 and configured to engage a portion of the roll 102 of sheet product. For example, the resistance mechanism 180 may be configured to engage an outer surface of the roll 102. As is shown, the resistance mechanism 180 may be positioned behind the roll 102 and attached to the back wall 124 of the base 118. Alternatively, the resistance mechanism 180 may be positioned above the roll 102 and attached to the top wall 134 of the cover 102 or positioned in front of the roll 102 and attached to the front wall 130 of the cover 120.

The resistance mechanism 180 may include an engagement member 182 configured to frictionally engage the outer surface of the roll 102 while a user applies a pull force to the tail portion 106 of the roll. In this manner, the engagement member 182 may provide resistance to the pull force, which may reduce over-spin of the roll 102. The resistance mechanism 180 also may include a biasing member 184 configured to bias the engagement member 182 into engagement with the outer surface of the roll 102. As is shown, the engagement member 182 may be a plate that is pivotally connected to the back wall 124 of the base 118. In some embodiments, the engagement member 182 is a curved plate shaped to generally correspond to the curved outer surface of the roll 102. As is shown, the engagement member 182 may be fixedly attached to a shaft 186 that extends through and is rotatably supported by one or more supports 188 that are fixedly attached to the back wall 124. In this manner, the engagement member 182 may pivot with respect to the back wall 124 of the base 118. As is shown, the biasing member 184 may be a torsion spring configured to bias the engagement member 182 into engagement with the outer surface of the roll 102. In particular, the biasing member 184 may be a dual-coil torsion spring including a pair of coiled portions 190, a U-shaped portion 192 positioned between the coiled portions 190, and a pair of end portions 194 each extending from one of the coiled portions 190. As is shown, the shaft 186 may extend through and support the coiled portions 190, the U-shaped portion 192 may engage the back side of the engagement member 182, and the end portions 194 may engage the back wall 124. In this manner, the tendency of the U-shaped portion 192 and the end portions 194 to move away from one another may cause the biasing member 184 to bias the engagement member 182 into engagement with the roll 102. Ultimately, the resistance mechanism 180 may provide controlled dispensing of the sheet product and prevent or inhibit over-spin of the roll 102. It will be understood that the resistance mechanism 180 is optional and may not be included in some embodiments of the dispenser 100.

The components of the dispenser 100 may be formed from any durable material that is able to withstand the harsh operating conditions associated with industrial environments. In some embodiments, the components of the dispenser 100 may be formed from stainless steel, such as 304 stainless steel, which provides high durability and resistance to wear or failure, even after repeated wash-downs with acidic wash solutions.

In some embodiments, as shown, the dispenser 100 is a purely mechanical dispenser. In other words, in such embodiments, the dispenser 100 does not include any electronic or electrical components, such as a power source, an electric motor, an electronic sensor, or an electronic controller. In other embodiments, the dispenser 100 is an electromechanical dispenser, which may include one or more power sources, electric motors, electronic sensors, electronic controllers, or other electronic or electrical components.

The improved sheet product dispensers and related methods described herein for dispensing sheet product in industrial environments advantageously address the shortcomings of dispensers currently used in such environments. In particular, the sheet product dispensers may include the housing and the plurality of plates configured to protect the roll of sheet product during daily operations and periodic wash-downs, resulting in reduced waste of sheet product. As described above, the plates (which otherwise may be referred to generally as "barriers," "shields," "separators," "dividers," "buffers," or "screens") may be configured to prevent or inhibit liquids from entering the interior space of the housing and also to facilitate draining of liquids that do enter the interior space. The sheet product dispensers also may include the resistance mechanism configured to provide controlled dispensing of the sheet product and to prevent or inhibit over-spin of the roll, resulting in reduced waste of sheet product and improved user experience. Finally, the sheet product dispensers may include the tear edges of the cover configured to facilitate tearing of a length of sheet product from the roll, resulting in improved user experience. As described above, the tear edges provide ease of use and flexibility for the user, while also reducing the likelihood of potential grime buildup on the dispenser and potential harm to the user. Importantly, the dispensers and methods described herein achieve these benefits through a relatively simple mechanical configuration that is able to withstand the requisite high frequency of use and harsh operating conditions associated with industrial environments, such as food processing facilities.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific sheet product dispenser configurations, it will be appreciated that numerous other sheet product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A sheet product dispenser for dispensing sheet product from a roll of sheet product, the dispenser comprising:

a housing defining an interior space configured to receive the roll of sheet product therein, the housing comprising:

a base configured to attach to a wall or other support surface for mounting the dispenser thereto;

a cover connected to the base and configured to move relative to the base from an open position to a closed position;

a dispensing gap in communication with the interior space and configured to allow a tail portion of the roll of sheet product to extend therethrough and out of the interior space;

a drainage gap in communication with the interior space and configured to allow a liquid to drain therethrough and out of the interior space, wherein the drainage gap is spaced apart from the dispensing gap and positioned below the dispensing gap; and a first angled plate and a second angled plate positioned about a bottom of the housing, wherein the first angled plate and the second angled plate are spaced apart to define the drainage gap therebetween; and a roll support positioned within the interior space and configured to rotatably support the roll of sheet product.

2. The sheet product dispenser of claim 1, wherein the first angled plate and the second angled plate are angled downward toward the drainage gap to facilitate draining of the liquid therethrough.

3. The sheet product dispenser of claim 1, wherein the housing further comprises a first shield positioned at least partially within the drainage gap.

4. The sheet product dispenser of claim 3, wherein the first shield is positioned at least partially below the drainage gap.

5. The sheet product dispenser of claim 3, wherein the first angled plate, the second angled plate, and the first shield are configured to inhibit a flow of liquid from entering the interior space through the drainage gap.

6. The sheet product dispenser of claim 1, wherein, when the cover is in the closed position, the second angled plate and the cover are spaced apart to define the dispensing gap therebetween.

7. The sheet product dispenser of claim 1, wherein the cover comprises a front wall, a first side wall, and a second side wall, and wherein the front wall, the first side wall and the second side wall each comprise a tear edge extending along a bottom edge thereof.

8. The sheet product dispenser of claim 7, wherein the tear edges each comprise a plurality of rounded teeth.

9. The sheet product dispenser of claim 1, wherein the roll support comprises a first spring arm and a second spring arm configured to deflect away from one another upon insertion of the roll of sheet product therebetween, wherein the first spring arm and the second spring arm each comprise a protrusion configured for insertion into a central opening of the roll of sheet product, and wherein the protrusions each comprise an angled surface configured to facilitate insertion of the roll of sheet product between the first spring arm and the second spring arm.

10. The sheet product dispenser of claim 1, further comprising a resistance mechanism positioned within the interior space and configured to engage an outer surface of the roll of sheet product and resist rotation of the roll of sheet product about the roll support, wherein the resistance mechanism comprises an engagement member configured to frictionally engage the outer surface of the roll of sheet product, and a biasing member configured to bias the engagement member into engagement with the outer surface of the roll of sheet product.

11. The sheet product dispenser of claim 1, wherein the first angled plate and the second angled plate each have a planar shape, wherein the first angled plate is positioned about a back portion of the housing, and wherein the second angled plate is positioned about a front portion of the housing.

12. A sheet product dispenser for dispensing sheet product from a roll of sheet product, the dispenser comprising:

a housing defining an interior space configured to receive the roll of sheet product therein, the housing comprising:

a dispensing gap in communication with the interior space and configured to allow a tail portion of the roll of sheet product to extend therethrough and out of the interior space;

a drainage gap in communication with the interior space and configured to allow a liquid to drain therethrough and out of the interior space, wherein the drainage gap is spaced apart from the dispensing gap; and a first shield positioned at least partially within the drainage gap; and a roll support positioned within the interior space and configured to rotatably support the roll of sheet product.

13. The sheet product dispenser of claim 12, wherein the housing further comprises a first angled plate and a second angled plate positioned about a bottom of the housing, and wherein the first angled plate and the second angled plate are spaced apart to define the drainage gap therebetween.

14. The sheet product dispenser of claim 13, wherein the first angled plate and the second angled plate are angled downward toward the drainage gap to facilitate draining of the liquid therethrough.

15. The sheet product dispenser of claim 13, wherein the housing further comprises a base configured to attach to a wall or other support surface for mounting the dispenser thereto, and a cover connected to the base and configured to move relative to the base from an open position to a closed position, and wherein, when the cover is in the closed position, the second angled plate and the cover are spaced apart to define the dispensing gap therebetween.

16. The sheet product dispenser of claim 13, wherein a width of the first shield is greater than a width of the drainage gap such that the first shield overlaps a portion of the first angled plate and a portion of the second angled plate.

17. The sheet product dispenser of claim 12, wherein the first shield comprises:

a top portion positioned above the drainage gap;

a bottom portion positioned below the drainage gap; and an intermediate portion positioned within the drainage gap.

18. The sheet product dispenser of claim 12, wherein the first shield comprises a first portion angled downward in a first direction and a second portion angled downward in a second direction different from the first direction.

19. A method of protecting a roll of sheet product within a sheet product dispenser, the method comprising:

providing the roll of sheet product rotatably supported by a roll support within an interior space of a housing of the sheet product dispenser;

allowing a tail portion of the roll of sheet product to extend through a dispensing gap of the housing and out of the interior space;

allowing a liquid to drain through a drainage gap of the housing and out of the interior space, wherein the drainage gap is spaced apart from the dispensing gap and positioned below the dispensing gap; and directing the liquid downward and toward the drainage gap via a first angled plate and a second angled plate of the housing, wherein the first angled plate and the second angled plate are positioned about a bottom of the housing and spaced apart to define the drainage gap therebetween.

20. The method of claim 19, further comprising inhibiting a flow of liquid from entering the interior space through the drainage gap via a first shield positioned at least partially within the drainage gap.

* * * * *